US009573718B2

(12) United States Patent
Austermeier et al.

(10) Patent No.: US 9,573,718 B2
(45) Date of Patent: Feb. 21, 2017

(54) WINDING REEL FOR LABEL DISPENSER

(71) Applicant: Multivac Marking & Inspection GmbH & Co. KG, Enger (DE)

(72) Inventors: Georg Austermeier, Hoevelhof (DE); Markus Dauwe, Hilter (DE); Bernd Rath, Enger (DE)

(73) Assignee: MULTIVAC MARKING & INSPECTION GMBH & CO. KG, Enger (DE)

( * ) Notice: Subject to any disclaimer, the term of this patent is extended or adjusted under 35 U.S.C. 154(b) by 84 days.

(21) Appl. No.: 14/701,394

(22) Filed: Apr. 30, 2015

(65) Prior Publication Data

US 2015/0314905 A1 Nov. 5, 2015

(30) Foreign Application Priority Data

May 5, 2014 (EP) ..... 14167035

(51) Int. Cl.

| | |
|---|---|
| ***B65H 75/22*** | (2006.01) |
| ***B65C 9/42*** | (2006.01) |
| ***B65H 75/28*** | (2006.01) |
| ***B65C 9/18*** | (2006.01) |
| ***B65H 75/24*** | (2006.01) |

(52) U.S. Cl.

CPC ..... *B65C 9/42* (2013.01); *B65C 9/1892* (2013.01); *B65H 75/242* (2013.01); *B65H 75/28* (2013.01)

(58) Field of Classification Search

CPC ..... B65H 75/22; B65H 75/24; B65H 75/242; B65C 9/42; B65C 9/1892

See application file for complete search history.

(56) References Cited

U.S. PATENT DOCUMENTS

| | | | | |
|---|---|---|---|---|
| 1,174,843 A * | 3/1916 | Frohlich | ..... | B65H 75/248 242/574.1 |
| 3,421,712 A | 1/1969 | Scroggie et al. | | |
| 3,918,659 A * | 11/1975 | Padgett, Jr. | ..... | B65H 49/30 242/571.6 |
| 4,221,347 A * | 9/1980 | Hill | ..... | B65H 75/22 242/573.6 |
| 4,300,727 A * | 11/1981 | Koch | ..... | B65H 75/248 242/574.1 |
| 4,995,569 A | 2/1991 | Alexander | | |

(Continued)

FOREIGN PATENT DOCUMENTS

| | | |
|---|---|---|
| CN | 102673852 A | 9/2012 |
| CN | 102991787 A | 3/2013 |

(Continued)

*Primary Examiner* — Sang Kim

(74) *Attorney, Agent, or Firm* — Husch Blackwell LLP

(57) ABSTRACT

The present invention relates to a winding reel for a label dispenser and a method allowing a roll of a wound-up label carrier tape to be easily removed from the winding reel. A first rod of the winding reel is connected to a rotating element in a movable manner and at least two additional rods are connected to the rotating element in a stationary manner. An operating element is pivotably arranged on the free ends of the two stationarily arranged rods, where the operating element is connected to the free end of the first rod and configured such that it causes a deflection of the free end of the first rod in the direction of the rotary axis.

15 Claims, 6 Drawing Sheets

(56) References Cited

U.S. PATENT DOCUMENTS

| | | | | |
|---|---|---|---|---|
| 6,345,781 | B1 * | 2/2002 | Bowers | B65H 16/06 242/422.4 |
| 7,128,291 | B1 * | 10/2006 | Schanke | B65H 19/305 242/533.7 |
| 2006/0188312 | A1 | 8/2006 | Ward | |
| 2007/0278342 | A1 | 12/2007 | Harkins | |

FOREIGN PATENT DOCUMENTS

| | | | |
|---|---|---|---|
| DE | 19942310 | C1 | 3/2001 |
| DE | 10218840 | A1 | 11/2003 |
| FR | 2770502 | A1 | 5/1999 |

* cited by examiner

WINDING REEL FOR LABEL DISPENSER

CROSS-REFERENCE TO RELATED APPLICATIONS

This Application claims priority to European Patent Application Number 14167035.6 filed May 5, 2014, to Georg Austermeier et al., currently pending, the entire disclosure of which is incorporated herein by reference.

FIELD OF THE INVENTION

The present invention relates to a winding reel for a label dispenser and to a method for operating the winding reel and label dispenser.

BACKGROUND OF THE INVENTION

DE 199 42 310 C1 discloses a winding reel having three rods accommodated on a rotating element and rotating about a rotary axis and an empty label carrier tape windable onto the rods. The three rods are arranged on a common radius around the rotary axis of the winding reel. To remove a roll of wound-up label carrier tape from the winding reel, it is necessary to bend the free end of at least one of these three rods inwards in the direction of the rotary axis in order to reduce the friction of the label carrier tape on the rods to such an extent that the roll of label carrier tape can manually be removed in the direction of the free ends of the rods. A drawback of this solution is the expenditure of force, which is applied to the winding reel itself with one hand, and the necessity of removing the roll with the other hand; a procedure that is disadvantageous from the ergonomic point of view.

US 2007/0278342 A1 discloses another embodiment of a winding reel, which has a complicated structural design and which is not hygienic because it is difficult to clean.

SUMMARY OF THE INVENTION

It is an object of the present invention to improve the winding reel of a label dispenser in regards to its handling for the purpose of removing a roll of a wound-up label carrier tape.

The winding reel for a label dispenser according to one embodiment of the present invention comprises a rotating element provided with at least three rods oriented parallel to a rotary axis of the rotating element, where each of the rods have a free end that faces away from the rotating element. The winding reel may be characterized in that a first rod can be connected to the rotating element in a movable manner and at least two rods can be connected to the rotating element in a stationary manner. The winding reel may also be characterized in that an operating element may be pivotably arranged on the free ends of the stationarily arranged rods, where the operating element can be connected to the free end of the first rod and configured to cause, when operated, a deflection of the free end of the first rod in the direction of the rotary axis. The deflection of the first rod may result in a reduction of the diameter having the label carrier tape wound thereon, which may reduce the friction of the label carrier tape on the rods and allow the label carrier tape to be easily removed along the rods.

According to one embodiment of the present invention, the first rod is connected to the rotating element by means of a pivot joint. The pivot axis defined by the joint may extend substantially perpendicular to the pivot axis of the rotating element.

The first rod may be connected to the operating element by means of a joint, which may be at the free end thereof, so as to move the first rod from a winding position to a position of change, when the operating element is pivoted. In a first phase, the free end of the first rod may be tilted radially inwards towards the rotary axis and pivoted about the second joint on the rotating element. In an optional second phase, the movable rod may be moved, in a substantially axial movement, away from the rotating element together with a superimposed pivot movement of the second joint, so that, at the position of change, the first rod can have an orientation approximately parallel to the rotary axis, but occupy a position at which it has approached the rotary axis in a radial direction. The roll of the wound-up label carrier tape may thus rest loosely on the winding reel.

According to one embodiment of the present invention, the first and/or second joint is/are provided with a joint lever. This joint lever may define a respective pivot axis at both ends thereof, where the two pivot axes may be parallel to one another. The joint lever on the first joint may define a first pivot axis between itself and the operating element and a second pivot axis between itself and the movable rod. A joint lever provided on the second joint may define, analogously thereto, a first pivot axis between itself and the movable rod and a second pivot axis between itself and the rotating element. When such a joint lever is provided on the first as well as on the second joint, all of the four pivot axes may be parallel to one another according to one embodiment of the present invention.

The joint lever may have the shape of a chain link of the type normally used in a chain. The chain link may comprise two side parts and two bolts, where the chain link can be supported on one end of the first rod by means of one of the bolts.

According to one embodiment, the operating element is provided with a lever for operating the operating element and also pivoting and tilting the operating element.

The operating element can be provided with a support to provide protection against inadvertent pivoting of the operating element at the operating position.

According to one embodiment of the present invention, the term "stationary" may mean that the rods connected to the rotating element will not change their position relative to the rotating element. The rods connected to the rotating element in a stationary manner may be connected to said rotating element either rigidly or such that they are rotatable about their own axis.

According to one embodiment of the present invention, all the rods are spaced at the same radial distance from the rotary axis of the rotating element at a winding position of the winding reel. In alternative embodiments, the rods are spaced at different radial distances. When all of the rods are spaced at the same radial distance from the rotary axis at the winding position, all the rods can be located on a common circular path around the rotary axis, when the rods are seen in a projection parallel to the rotary axis of the rotating element. This may result in a homogeneous, approximately circular movement of the label carrier tape wound onto the winding reel.

A particularly uniform movement of the label carrier tape may be achieved when all the rods are arranged equidistantly on a common circular path around a rotary axis of the rotating element, when seen in a projection parallel to the rotary axis of the rotating element, according to one embodiment of the present invention.

According to one embodiment of the present invention, the total number of rods provided is an even number. The support of the operating element may cooperate with the stationarily arranged rod, which can be arranged on the common circular path such that it is displaced by 180 degrees relative to the movable rod. In other words, this stationarily arranged rod, with which the support of the operating element cooperates, may be, relative to the rotary axis of the rotating element, axially symmetric with respect to the movable rod, when the latter is at its winding or operating position.

Handling the winding reel may be facilitated when the operating element does not constitute a disturbing contour during the removal of the roll of label carrier tape. This can be accomplished by arranging the operating element fully inside of a contour when at the position of change, which may result from a projection parallel to the rotary axis of the rotating element and the corners of which are defined by the movable rod and the stationary rods. When the operating element does not protrude beyond this contour at the position of change, it may no longer represent a disturbing contour and may thus facilitate the removal of the label carrier tape.

According to one embodiment of the present invention, the winding reel comprises at least six rods so as to cause the label carrier tape to be wound up in an approximately circular fashion.

A method, according to one embodiment of the present invention, for operating the winding reel may comprise the following steps:

- moving the operating element about a pivot axis at the free ends of two stationary rods having the operating element rotatably supported thereon, from an operating position to a position of change; and
- pivoting the free end of the movable rod about a pivot axis of a joint of the movable rod inwards towards the rotary axis of the rotating element.

Due to the pivoting of the free end of the movable rod (i.e., due to the tilting of the movable rod towards the rotary axis of the rotating element), the mean distance between the movable rod and the rotary axis may decrease and, consequently, there may be a decrease in the friction exerted from inside on the wound-up roll of label carrier tape. This may allow the roll of label carrier tape to be more easily removed from the winding reel.

The removal of the roll of label carrier tape can also be facilitated when the first tilting movement of the movable rod is followed by a second tilting movement, by means of the inner end of the movable rod, which faces the rotating element, is moved closer to the rotary axis. This can be accomplished by providing between the movable rod and the rotating element a joint lever and, in the second phase of movement, tilting the joint lever about a pivot axis provided between the joint lever and the rotating element. In the course of this movement, the movable rod may move away from the rotating element and arrive at a position, at which the whole movable rod is again oriented, at least approximately, parallel to the rotary axis, but may now be located closer to the rotary axis than when it occupied the winding position. This second phase of movement may be caused by continuing the pivoting of the operating element in the same direction as in the first phase, in particular by manually pivoting the operating element.

The steps described can be carried out by the operator with a continuous movement of the operating element, whereupon the roll of label carrier tape can be removed from the winding reel, with both hands, in an ergonomically advantageous manner. Thus, it is also possible to removed larger rolls or flexible carrier tapes exhibiting a tensile stress during winding.

According to one embodiment, the support of the operating element rests, at the operating position, on a rod which is in contact with the support at a dead center position of the operating element and the chain link.

The support and the lever of the operating element may also be provided on two opposite sides of the operating element.

Other and further objects of the invention, together with the features of novelty appurtenant thereto, will appear in the course of the following description

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

Like components are designated by like reference numerals throughout the figures.

DETAILED DESCRIPTION OF THE INVENTION

Figure 1:
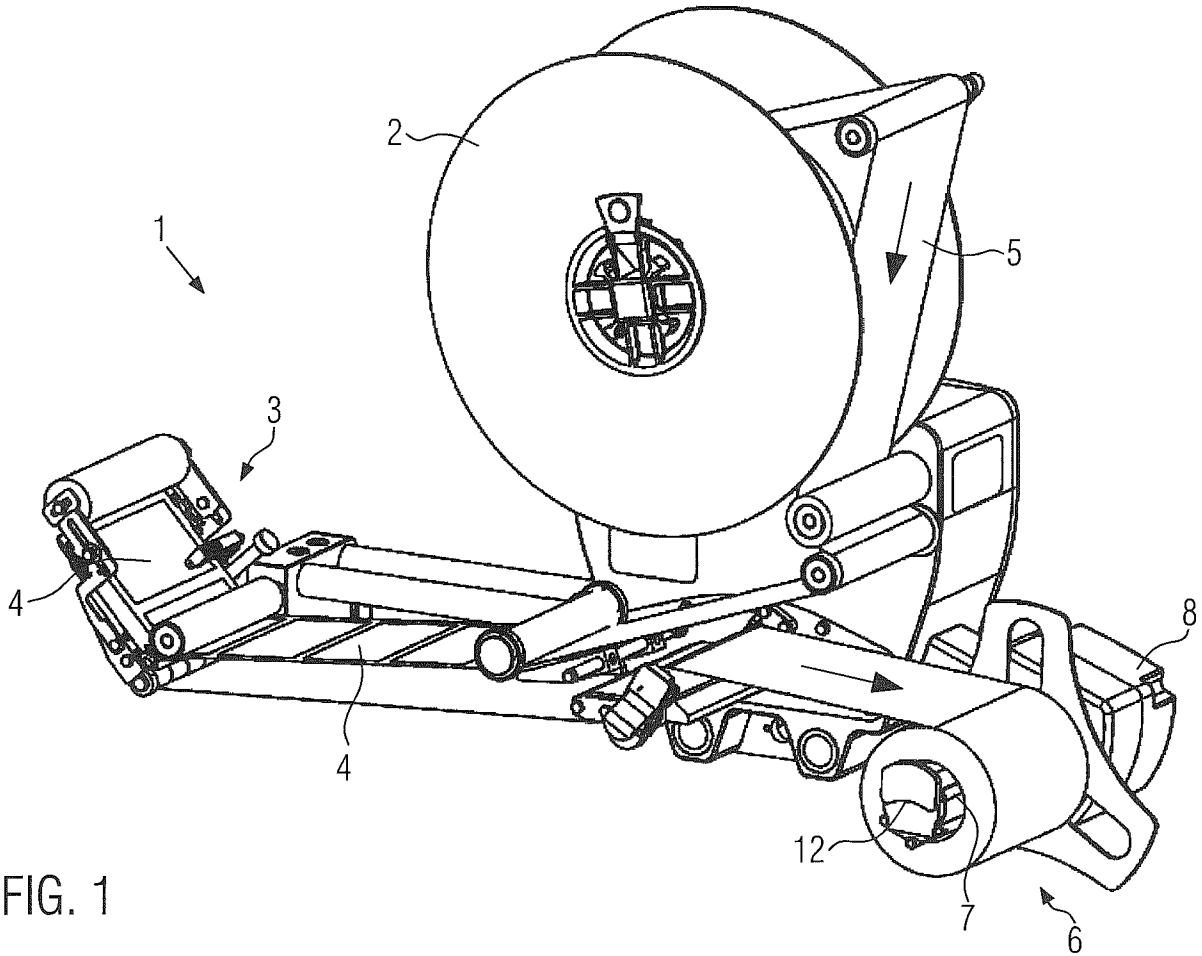
FIG. 1 is a side perspective view of a label dispenser with a winding reel according to one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a label dispenser 1, according to one embodiment of the present invention, comprising an unwinder 2 for unwinding a label carrier tape 5 with labels 4 and a dispenser 3 for dispensing individual labels 4 from the label carrier tape 5. For winding up the label carrier tape 5, a winding unit 6 may be provided. The winding unit 6 may comprise a winding reel 7 onto which the label carrier tape 5 may be wound. The winding reel 7 may be driven by means of a motor 8, which may be a stepping motor, a servomotor, or any other suitable motor. The two arrows shown in FIG. 1 indicate the direction of movement of the label carrier tape 5.

Figure 2:
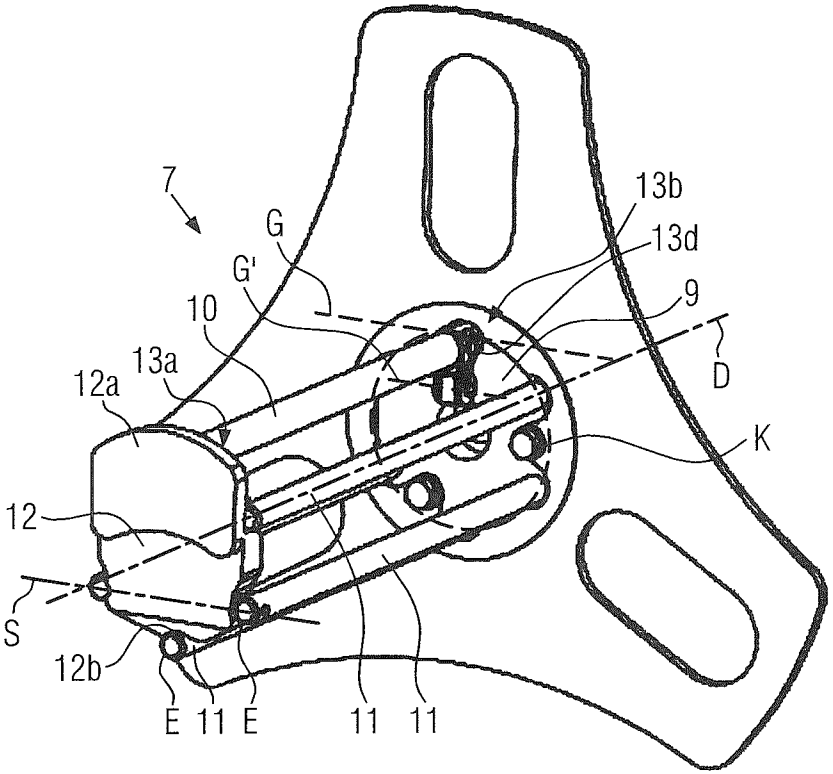
FIG. 2 is a side perspective view of the winding reel of FIG. 1.
Figure 6:
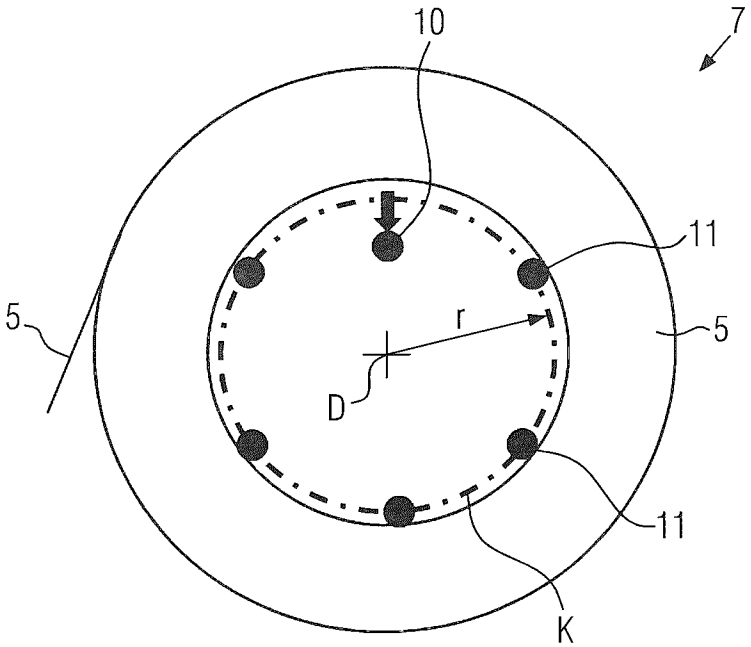
FIG. 6 is a schematic side view of the winding reel of FIG. 1 illustrating the winding reel at the position of change, in a projection parallel to the rotary axis, according to one embodiment of the present invention.

FIG. 2 shows the winding reel 7, which may comprise a rotating element 9. The rotating element 9 may have attached thereto a first moveable rod 10 and five stationary rods 11. The rods 10, 11 may extend orthogonally to the rotating element 9 and, in a projection parallel to a rotary axis D of the rotating element 9, each may be spaced at the same radial distance r from the rotary axis D (as best shown in FIG. 6), when occupying the winding position. In such an embodiment, the rods 10, 11 are arranged equidistantly on a common circular path K around a common rotary axis D of the winding reel 7, as best shown in FIG. 6. Each of the rods 10, 11 may have a free end E, which may face away, or is directed away, from the rotating element 9.

The winding reel 7 may comprise an operating element 12 that may be supported on two stationary rods 11 such that it is rotatable about a pivot axis S. The operating element 12 may comprise a lever 12*a* and a support 12*b*. At an operating position, which may correspond to a winding position, the support 12*b* may cooperate with another stationary rod 11, which, relative to the rotary axis D, may be arranged axially symmetric with respect to the movable rod 10. This may allow for a dead center position and/or a clamping force to be established, so as to prevent inadvertent pivoting of the operating element 12 away from the operating position.

One end of the first movable rod 10 may be articulated on the rotating element 9 by means of a second joint 13*b*, which may allow the rod 10 to be pivotable at least about a pivot axis G of the second joint 13*b*. According to such an embodiment, the second joint 13*b* may comprise a joint lever 13*d* having the shape of a chain link of a conventional chain and defining at each of its two ends a respective pivot axis G, G'. The movable rod 10 may be pivotable about the first pivot axis G relative to the joint lever 13*d*. The joint lever 13*d* itself may be connected to the rotating element 9 such that it is pivotable about the second pivot axis G'.

Figure 3:
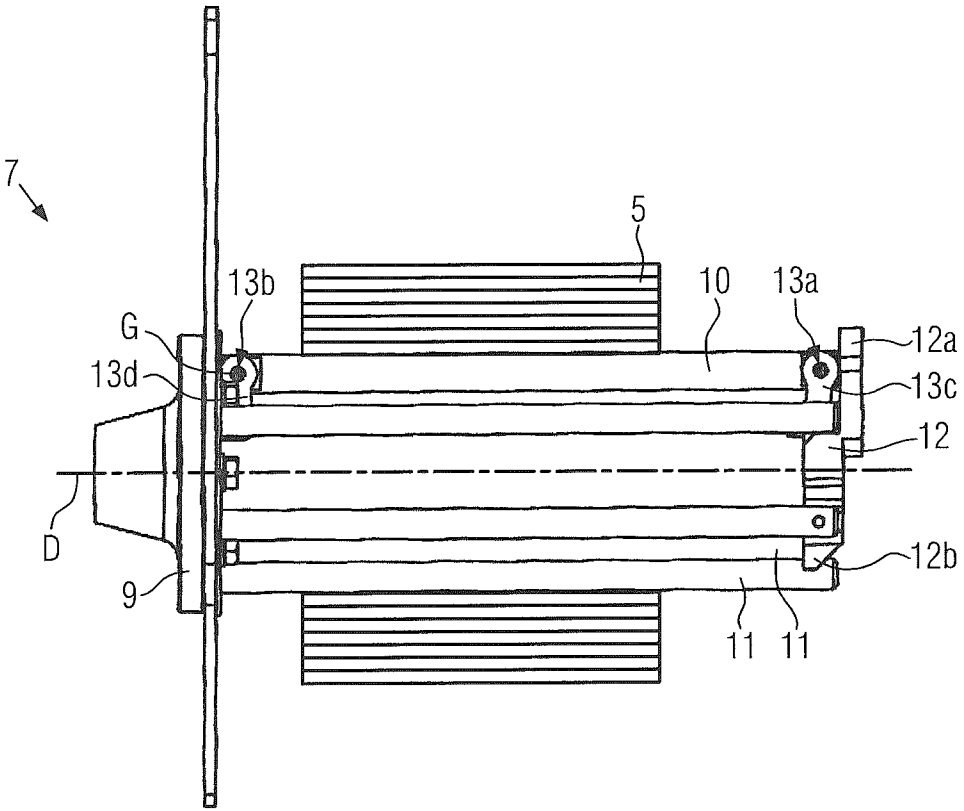
FIG. 3 is a front elevation view of the winding reel of FIG. 1 illustrating in the winding reel at a winding position and the winding direction according to one embodiment of the present invention.

The opposite free end E of the first rod 10 may be articulated on the lever 12*a* of the operating element 12 by means of a first joint 13*a*, as shown in FIG. 3, such that a deflection of the free end E of the first rod 10 in the direction of the rotary axis D can be caused. The first joint 13*a* may comprise a joint lever 13*c*, which, analogously to the joint lever 13*d*, may also have substantially the shape of a conventional chain link and defines at its two ends two pivot axes. Via the first pivot axis, the joint lever 13*c* may be pivotably connected to the first rod 10, and via the second pivot axis, it may be pivotably connected to the lever 12*a* of the operating element 12. Each of the four pivot axes of the two joint levers 13*c*, 13*d* may extend parallel to one another in this embodiment.

FIG. 3 shows the winding reel 7 in the winding direction according to one embodiment of the present invention. The winding reel 7 is shown at its winding position. At this position, all rods 10, 11 may be located on the circular path K around the rotary axis D, and the first rod 10 may be oriented parallel to the additional stationary rods 11 and the rotary axis D. The lever 12*a* of the operating element 12 may be connected to the first joint 13*a*. The support 12*b* may be in contact with the lowermost stationary rod 11 as shown in FIG. 3.

Figure 4:
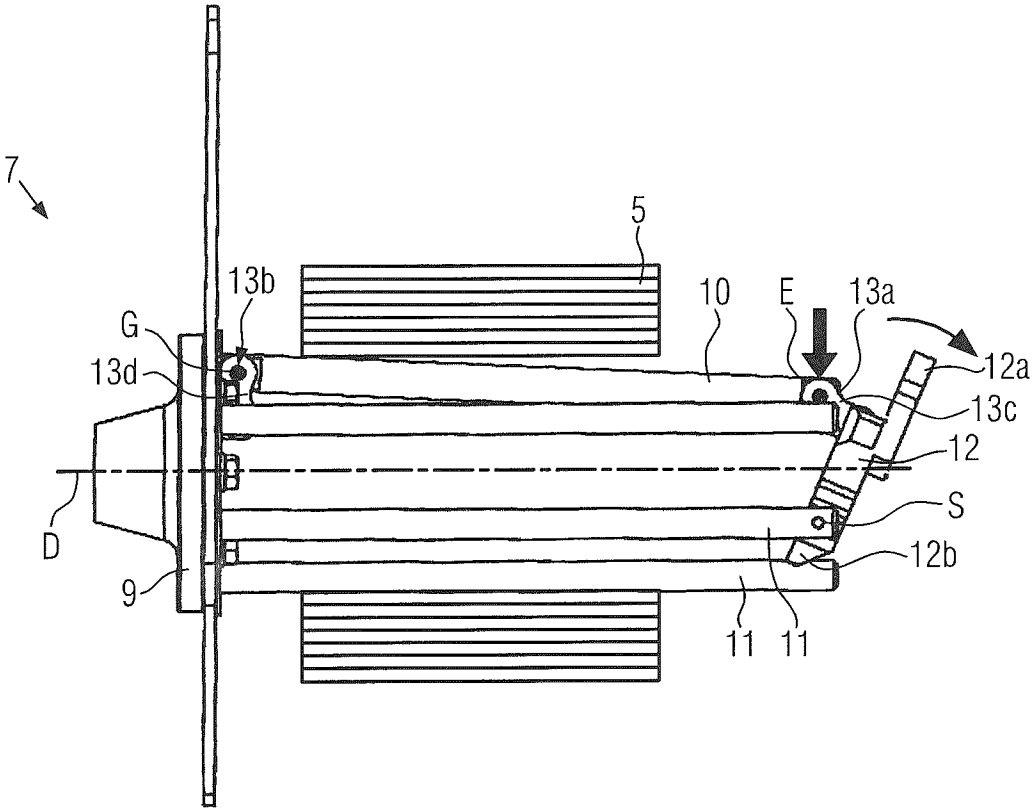
FIG. 4 is a front elevation view of the winding reel of FIG. 1 illustrating the winding reel at an intermediate position according to one embodiment of the present invention.

In the following, a method for operating the winding reel 7, according to one embodiment of the present invention, will be described making reference to FIGS. 3 to 5. In FIG. 3, the winding reel 7 is at its operating position and the label carrier tape 5 is wound onto the winding reel 7 by rotating the latter. When the label carrier tape 5 is to be removed from the winding reel 7, an operator may manually pivot, as shown in FIG. 4, the operating element 12 on the lever 12*a* to the right (i.e., away from the label carrier tape 5), about the pivot axis S of the operating element 12. The pivot axis S can be defined by the rotatable supports in the two stationary rods 11 to which the operating element 12 is connected. In the course of this process, the support 12*b* of the operating element 12 can move away from the rod 11 with which said support 12*b* was in contact at the operating position. At the same time, the movement of the joint lever 13*c* of the first joint 13*a*, which can be connected to the lever 12*a*, causes the movable rod 10 to tilt about the pivot axis G between said rod 10 and the joint lever 13*d* on the second joint 13*b*, thus causing the free end E of the first rod 10 to move down in the direction of the rotary axis D. Hence, the first rod 10 moves, at least partially, away from the interior of the wound-up label carrier tape 5, so that the tension of the label carrier tape 5 on the first rod 10 will decrease and the friction originating from the contact between said label carrier tape 5 and the first rod 10 will be reduced.

Figure 5:
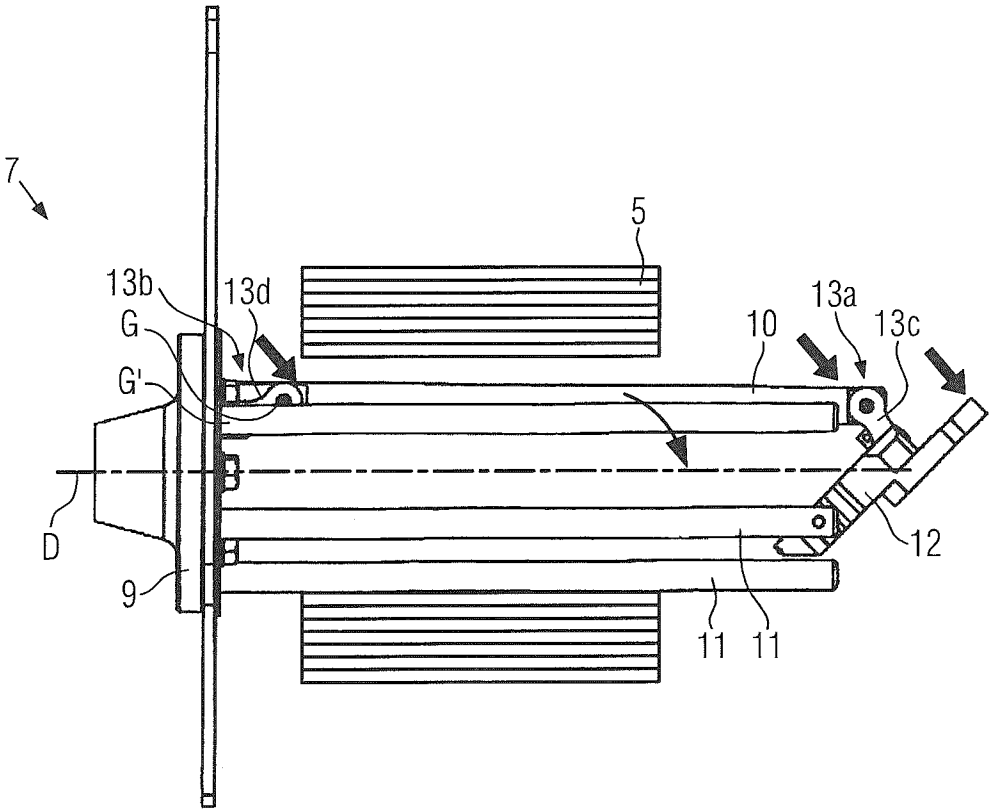
FIG. 5 is a front elevation view of the winding reel of FIG. 1 illustrating the winding reel at a position of change for removing a wound-up label carrier tape according to one embodiment of the present invention.

Subsequently, the operator may continue to pivot, as shown in FIG. 5, the operating element 12 in the same direction (i.e., the direction of the arrow at the operating element 12). During this continued movement of the first rod 10, the second joint 13*b* on the rotating element 9 ensures that also the end of the first rod 10 attached thereto can radially approach the rotary axis D. This can be accomplished during the second phase of movement when the joint lever 13*d* of the second joint 13*b* pivots about the pivot axis G' between the joint lever 13*d* and the rotating element 9. This pivoting movement results in a movement that may cause the inner end of the movable rod 10 that faces the rotating element 9 to approach the rotary axis D and that simultaneously can move the inner end away from the rotating element 9. This second phase of movement of the first rod 10 is optional according to one embodiment of the present invention. In an alternative embodiment of the present invention, the second joint 13*b* does not comprise a joint lever, but only a pivot axis G directly between the movable rod 10 and the rotating element 9.

FIG. 6 shows how, at the end of pivoting movement, the first rod 10 may extend to a very large extent parallel to the other rods 11, but may also be located inside of the circular path K and thus closer to the rotary axis D than the stationary rods 11. At this position of change, the operator will be able to axially remove the wound-up carrier tape 5 from the winding reel 7 without major efforts. The operating element 12 can be configured such that, at the position of change, the outer dimensions or outer contour of the operating element 12 may be located inside of the outer contour or outer side of all the rods 10, 11, so that no disturbing contour will be created during the removal of the carrier tape 5.

Taking all this into account, it may suffice when, according to one embodiment of the present invention, only a single rod 10 is movable relative to the rotating element 9, whereas all the other rods are connected to the rotating element 9 such that they are stationary relative thereto.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms are used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations, and other uses and applications which do not depart from the spirit and scope of the invention are deeded to be covered by the invention which is limited only by the claims which follow.

What is claimed is:

1. A winding reel for a label dispenser, said winding reel comprising:

a rotating element;

at least three rods; and an operating element;

wherein each of said at least three rods is connected to said rotating element, is oriented parallel to a rotary axis of said rotating element, and includes a free end that faces away from said rotating element;

wherein a first movable rod of said at least three rods is connected to the rotating element in a movable manner and two rods of said at least three rods are connected to said rotating element in a stationary manner; and wherein said operating element is pivotably arranged on said free ends of said two stationarily arranged rods and connected to said free end of said first movable rod and configured to cause, when operated, a deflection of said free end of said first movable rod in the direction of said rotary axis.

2. The winding reel according to claim 1, wherein said first movable rod is connected to said rotating element by means of a second joint.

3. The winding reel according to claim 2, wherein said first joint is provided with a joint lever.

4. The winding reel according to claim 3, wherein said joint lever has a pivot axis at each of said joint lever's two ends.

5. The winding reel according to claim 1, wherein said first movable rod is connected to said operating element by means of a first joint at said free end of said first movable rod.

6. The winding reel according to claim 1, wherein said operating element is provided with a lever.

7. The winding reel according to claim 1, wherein said operating element is provided with a support.

8. The winding reel according to claim 7, wherein said at least three rods comprises an even number of rods, and wherein said support of said operating element is configured for cooperating with a stationary rod that is arranged on a circular path around said rotary axis such that it is displaced by approximately 180 degrees relative to said first movable rod.

9. The winding reel according to claim 1, wherein, at an operating position of said winding reel, each of said at least three rods are spaced at a same radial distance from said rotary axis of said rotating element.

10. The winding reel according to claim 1, wherein, at a winding position of said winding reel, all said rods are, in a projection parallel to said rotary axis, arranged equidistantly on a circular path around said rotary axis of said rotating element, said circular path being defined by said same radial distance of said rods from said rotary axis.

11. The winding reel according to claim 1, wherein, at a position of change, said operating element is arranged fully inside of a contour defined by a position of said at least three rods in a projection parallel to said rotary axis of said rotating element.

12. The winding reel according to claim 1, wherein said winding reel comprises at least six rods.

13. A method for operating a winding reel for winding-up a label carrier tape on a label dispenser, wherein said winding reel comprises a rotating element, at least three rods, and an operating element, and wherein said rotating element is rotatable about a rotary axis and has connected thereto said rods which are oriented parallel to said rotary axis when occupying a winding position, and wherein each of said rods has a free end that faces away from said rotating element, and wherein said rods comprise a first movable rod connected to said rotating element in a movable manner and two stationary rods connected to said rotating element in a stationary manner, said method comprising the steps of:

pivoting said operating element about an operating element pivot axis at said free ends of said two stationary rods from an operating position to a position of change; and pivoting said first movable rod about a first pivot axis of a second joint between said first movable rod and said rotating element to move said free end of the first movable rod closer to said first pivot axis of said rotating element.

14. The method according to claim 13, further comprising the steps of:

continuing the pivoting of said operating element;

pivoting a joint lever provided between said first movable rod and said rotating element about a second pivot axis between said joint lever and said rotating element; and moving said first movable rod in a direction away from said rotating element.

15. The method according to claim 13, wherein said operating element is provided with a support and said first movable rod is connected to said operating element by a first joint, and wherein, at said operating position, said support rests on one of said two stationary rods at a dead center position of said operating element and said first joint.

* * * * *